US006161977A

United States Patent [19]

Furukawa

[11] Patent Number: 6,161,977

[45] Date of Patent: Dec. 19, 2000

[54] POINT ASSEMBLY OF A BALL-POINT PEN

[75] Inventor: Kazuhiko Furukawa, Kanagawa, Japan

[73] Assignee: Mitsubishi Pencil Kabushiki Kaisha, Tokyo, Japan

[21] Appl. No.: 09/024,522

[22] Filed: Feb. 17, 1998

[30] Foreign Application Priority Data

Apr. 3, 1997 [JP] Japan ..... 9-099621

[51] Int. Cl.[7] ..... B43K 7/00; B43K 7/03; B43K 7/10

[52] U.S. Cl. ..... 401/209; 401/216

[58] Field of Search ..... 401/216, 209

[56] References Cited

U.S. PATENT DOCUMENTS

| | | | |
|---|---|---|---|
| 3,966,336 | 6/1976 | Lotfallah . | |
| 5,062,890 | 11/1991 | Miyashita et al. | 106/27 |
| 5,520,473 | 5/1996 | Durham | 401/216 |
| 5,762,434 | 6/1998 | Nagashima et al. | 401/209 |
| 5,899,618 | 5/1999 | Kobayashi et al. | 401/29 |

FOREIGN PATENT DOCUMENTS

| | | | |
|---|---|---|---|
| 2 749 221 | 12/1997 | France . | |
| 57-193578 | 12/1982 | Japan | 401/216 |
| 1 578 253 | 11/1980 | United Kingdom . | |
| WO 97/16499 | 5/1997 | WIPO . | |

*Primary Examiner*—Henry J. Recla
*Assistant Examiner*—Tuan Nguyen
*Attorney, Agent, or Firm*—Darby & Darby

[57] ABSTRACT

A point assembly has a multiple number of channels on its inside for establishing commutation of ink to the pen point, and the extradius of these channels is set approximately equal to or greater than the radius of the ball. Further, the point assembly has a sealing face having a curvature R which is approximately equal to that of the ball, and has a ball seat, on the rear side of the ball, having a curvature R being approximately equal to that of the ball. The surface roughness of these elements is set 5 $\mu$m or below. Further, this point assembly can be formed in an open V-shaped tapered configuration. Alternatively, the point assembly can be configured in combination with a spring provided therein which continuously urges the ball forwards or in combiation with an anti-backward leakage mechanism.

1 Claim, 3 Drawing Sheets

POINT ASSEMBLY OF A BALL-POINT PEN

BACKGROUND OF THE INVENTION (1) Field of the Invention

The present invention relates to a point assembly in which a ball disposed at its tip as a writing element is loosely held with some play and kept from slipping out with a properly sized gap which establishes a flow passage of ink, and further relates to improvement of a ball-point pen using this point assembly.

(2) Description of the Prior Art

A conventional ball-point type writing implement has caused the user to have a scratchy writing sensation at its initial state of use and often would come to give a more comfortable, smooth writing sensation as it was used longer. On the other hand, when a ball-point pen is used with a strong writing pressure, such as to prepare a multiple number of duplicates, the ball seat is worn out by the ball so that the ink would not come out, causing deficiency during writing despite the fact that ink still remains. This problem is liable to occur especially when a pigment type ink in which solid micro-powder particles are disposed as the coloring matter of the ink, is employed, or when an aqueous ink in which water is used as the base is used. To deal with these problem, there is a contrivance that the ball and/or the tip holder be formed of a high hardness material. In this case, however, the machining process of the tip holder also becomes difficult in proportion to its hardness, and the point assembly costs more. Attempt to solve the problem by modifying the ink, for example, blending of a smoothing agent into the ink, can alleviate the above defects. The smoothing agent, however, causes the ink to be liable to bloom on the paper, or lowers the surface tension of the ink, making the pen tip liable to become wet and hence the ink is liable to flow out from the pen tip (forward leakage) when the pen tip is oriented downward.

There are ball-point pens and small-tube type writing implements having a cap with a sealing element therein which is composed of elastic rubber, etc., and seals the pen point in order to prevent evaporation of ink when the pens are not used for a long period of time, or in order to prevent ink starvation or so-called forward leakage (ink drip from the pen point), which would occur due to drawing of air through the pen point when the pen is impacted by being dropped. However, in the case of a retractable or clicking type ball-point pen as well as in the case where the user has forgotten to fit the cap, in the case of a writing implement where a volatile type of ink is needed, and in other cases, ink starvation and air drawing tend to occur, and in the worst case the writing implement itself may accidentally become disabled. Countermeasures against such cases, include: inhibiting ink evaporation as much as possible by creating the parts of a ball-point pen, using metal; increasing the viscosity of ink (up to 5,000 cp to 10,000 cp); increasing the content of non-volatile solvent; decreasing the out-flow of ink by narrowing the ink flow channels in the point assembly; and creating an interior pressure insides the barrel interior equal to or higher than the pressure of the surrounding air to cause the interior ink to flow out. In particular, these problems have not been resolved for so-called intermediate type ball-point pens which use ink of a medium viscosity and present intermediate properties between oily and aqueous ball-point pens. Although ballpoint pens of this type have such imperfections, they have been put onto the market because of other merits. Recently, some products which are improved as to these problems have been invented, but no products are yet found which are free from the problem of wearing out in the interior of the point assembly.

SUMMARY OF THE INVENTION

The present invention is primarily to provide an improved writing implement of the so-called ball-point pen type wherein a ball projected from its tip as the writing point is loosely held with play inside the point assembly of a popular type and is kept from slipping out, especially relating the improvement of the point assembly of a ball-point pen.

It is the first object of the invention to provide a ball-point assembly which can ensure a smooth writing sensation from the initial stage of use, and is free from the problem of writing deficiencies halfway through its use with ink remaining, before the life of the pen element is complete. It is another object of the invention to provide an inexpensive, high performance writing implement having a point assembly which is able to prevent problems of dry-up, air drawing, forward leakage, etc., as well as troubles of writing performances, without needing a special ink or high-quality machining and without compromising the manufacturing performance of the sealing portion in the point assembly for sealing the interior from the outside air, by setting the interior sealing face for a writing ball and the ball-seat so as to have a radius of curvature R approximately equal to that of the writing ball.

The present invention has been devised to achieve the above objects, and the gist of the invention is as follows:

In accordance with the first aspect of the invention, a point assembly of a ball-point pen, includes; a ball, received on the rear side thereof by a ball seat and held on the front side thereof by a press-formed portion so that part of the ball is projected from the front, and rotatably and loosely held so that the back-and-forth movement of the ball is limited therebetween; an ink conduit disposed in the interior at the rear end for allowing ink to be lead to the ball; and a plurality of grooves which form channels so that the ball seat and the ink conduit communicate with one another in order to lead the writing ink to the front exterior of the pen point even when the ball abuts the ball seat and confines the ink conduit during writing, and is characterized in that the maximum extradius (B) of the channels defined by the plural grooves is equal to, or greater than, the radius (A) of the ball of a sphere having a diameter of 2A, (B=A or B>A).

The second aspect of the invention resides in the point assembly of a ball-point pen which has the above first feature and is characterized in that the ball seat having the ball abutted thereagainst and receiving writing pressure during writing, has a ball-receiving face having a radius of curvature R which is approximately equal to that of the ball, and the surface roughness Ra of the area of radius of radius of curvature R is 5 $\mu$m or below.

The third aspect of the invention resides in the point assembly of a ball-point pen which has the above first feature and characterized in that the inner brim of the press-formed portion at the pen tip, which the ball moves to and abuts against due to gravity when the pen tip is oriented downward, is formed of a sealing face having a curvature approximately equal to that of the ball, and the surface roughness Ra of the area of radius of curvature R is 5 $\mu$m or below.

In the ball-point pen of the invention thus configured, the ball to be the writing point is rotatably projected outwards from the tip and kept from slipping out so that the ink is stored in the ink reservoir. This ink flows through the ink path formed by a multiple number of channels formed with appropriate dimensions inside the point assembly, transverse clearances, longitudinal clearances which allow the ball to move back and forth and provide for the flow of ink, and is delivered out to the paper surface by way of the rotatable ball as the writing point.

This loosely fitted ball is held rotatably and kept from slipping out by a press-formed holding of plastic deformation.

In the most effective mode of the present invention, the extradius of the channels is equal to, or greater than, the radius of the writing ball, and this setting eliminates the problem of the ink passage being clogged due to wearing out.

The ball is prevented from slipping out by press-formed holding which is stabilized by optimizing the projected amount of the ball and the inside and outside diameters of press-formed portion. As an example, when press-formed, the portion to be press formed is pressed rather tightly so that the interior part of the press-formed portion abuts the ball, thus forming a sealing face inside the point assembly. This sealing face forms a whole circumferential brim having a certain width and a radius of curvature R approximately equal to that of the ball. Further, the ball seat which secures longitudinal clearances as well as receives the ball on its rear side with respect to the axial direction is also provided so as to have a radius of curvature R approximately equal to that of the ball. The areas, having a radius of curvature R approximately equal to that of the ball, against which the ball abuts, have a surface roughness Ra of 5 $\mu$m or below. This setting further enhances the effect of the first feature of the invention.

When the point assembly is provided with a spring therein which constantly urges the ball forward with a force as weak as 80 g or less (preferably 20 g or less) the present invention becomes more effective when it is applied to cases such as a clicking type ball-point pen etc. which need a higher tip performance and a higher resistance to forward leakage. In this case, when the spring is provided so as not to pass through the aforementioned channels, the operation of the spring becomes reliable.

In particular, the present invention is remarkably effective when applied to an intermediate type ball-point pen, which uses a pigment type aqueous ink having a viscosity of 10 cp to 5,000 cp at the temperature of 23° C.±5° C.

The operation of the above problem solving means will be described hereinbelow. In the improvement by the present invention, it becomes possible to secure an ink passage allowing high enough flow, and therefore it is possible to solve the problem of ink starvation due to some ink insufficiency at the initial stage of use. It is also possible to solve the problem in that the channels as the ink path tend to be confined causing difficulty in the flow of ink due to wearing out when the pen is being used in the latter half of its life.

Further, since the press-formed portion has a sealing portion on its internal surface thereof, which has the same shape or the same radius of curvature as that of the writing ball and has a smooth surface with a low enough surface roughness, it is possible to form a sealing portion which completely shuts out the surrounding air, thus making it possible to solve the problem of forward leakage. Further, since the press forming is performed by optimizing the angles, the outside and inside diameters after press forming, the seal surface can be effectively formed without any fluctuation. Additionally, since the flow of ink can be stabilized and the dimensions of each part can be sufficiently protected from wearing out, it is possible to prevent the ball from falling off as well as writing deficiencies.

When the ball seat which receives the ball during writing is adapted to have a radius of curvature R equal to that of the ball and a surface roughness of 5 $\mu$m or less, this setting, in combiation with the above effect of the improved flow of the channels, provides a doubly smooth writing sensation and more effectiveness against wearing out.

In particular, the present invention functions most effectively when it is applied to an intermediate type ball-point pen using an ink having a relatively low viscosity. Since the flow amount of this ink is plentiful and it is relatively difficult to provide lubricatability to the ink, the application of the invention is effective in solving forward leakage and the problem due to wearing out. As a result, it become possible to enhance the variety of the specifications of ink, consequently, it is possible to improve the total performance of the ball-point writing element.

DESCRIPTION OF THE PREFERRED EMBODIMENTS

Figure 1:
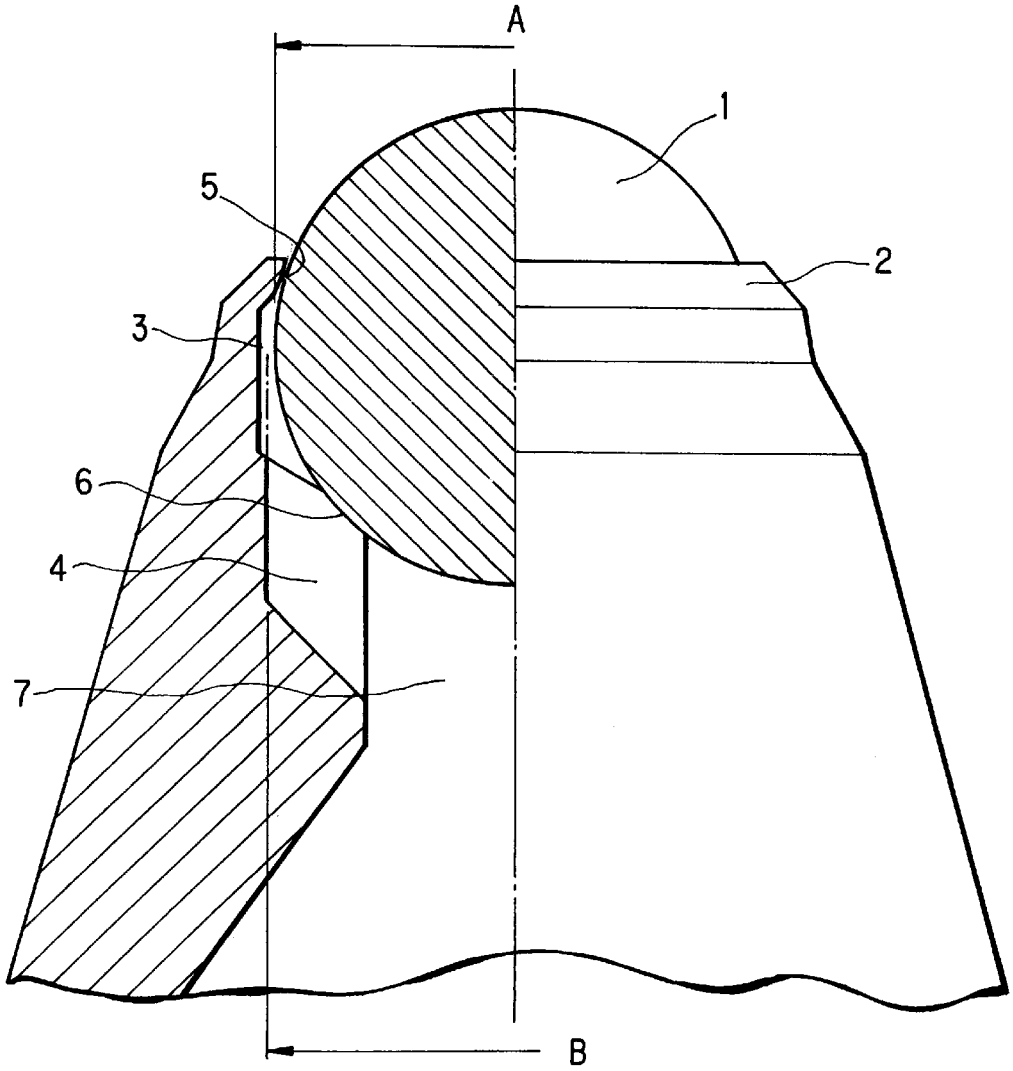
FIG. 1 is a vertical sectional view and external half view showing the structure of a point assembly at the front end of a ball-point pen in accordance with the embodiment of the present invention.

The description will be made in detail with reference to FIG. 1, which illustrates an example of a pen tip as the point assembly of a ball-point pen of the embodiment of the present invention.

Provided at the front end of the point assembly is a writing ball 1 which is received on its rear side by a ball seat 6 and held on its front side by a press-formed portion 2 so that it will not slip out. Ball 1 is loosely and rotatably held with a longitudinal clearances allowing back-and-forth movement. Press-formed portion 2 is formed with a press-forming angle of 50° to 110° (preferably, 70° to 90°). This press forming process is usually carried out by plastic deformation of metal or the combination of plastic deformation and machining. The interior face of this press-formed portion has a radius of curvature R which is substantially equal to that of the ball and forms a sealing face 5 with a surface roughness of 5 $\mu$m or less. In this arrangement, ball 1 abuts this sealing face 5, thus establishing a so-called sealed state, or securing confinement of the interior of the ball-point pen from the surrounding air.

In general, the sealing performance is considered to be improved as press-formed portion 2 is made more tight and the area of sealing face 5 is made greater. However, if this area is too large, the internal clearance becomes narrower or its friction on the ball becomes greater, decreasing the flow of ink and hence degrading the writing performance. In order to define the extent of the press-forming and the writing performance, it is important that the projected amount of the ball, the inside and outside diameters of the press-formed portion, the dimensions of the sealing face width, the press-forming angle and longitudinal clearances, etc. are appropriately selected in a related manner to meet the requirements of each type of pen.

In view of adjusting the scratchy feeling of the ball to the paper surface during writing, it is considered preferable (less scratchy) that the projected amount of the ball be set as large as possible. Therefore, this amount has been, in most cases, set at a value above which the ball can no longer be held. The inside and outside diameters of the press-formed portion were determined consequently by the projected amount of the ball (i.e., when the projected amount of the ball is smaller, the inside and outside diameters will be smaller). Even in the case where the projected amount of ball is relatively large, if the outside diameter is large, the scratchiness against the paper surface becomes large. On the other hand, some having a large inside diameter are liable to be worn out, at the internal front part, by writing, so that the ball would slip out resulting in a writing impossible. Besides, the projected amount of the ball, the inside and outside diameters and angle of the press-formed portion greatly affects the dimension of inside sealing face 5.

As a practical example of production, the inner wall (designated at 3) which is formed by machining fluctuates in surface roughness, so that ball 1 used should have a surface roughness of 5 $\mu$m or less (preferably 1 $\mu$m or less). This surface roughness of the ball can be transferred to the interior surface of the point assembly so that the interior face and its surface roughness will be set to have a radius of curvature R and be 5 $\mu$m or less.

Ball seat 6 provided at the rear of ball 1, is adapted to have the same radius of curvature R and have a surface roughness of 5 $\mu$m or less, which is equal to that of seal face 5, so that the placement of the ball during writing will be kept in a good state. Further, ball seat 6 is preferably sized 0.6 to 0.9 times the ball diameter A in order to prevent ball 1 from departing from ball seat 6 and wearing out the front internal side as well as to establish the necessary longitudinal clearance. Ink can move from the ink reservoir to the interior of the point assembly, and can flow to ball 1 by the presence of a ink conduit 7 and channels 4, longitudinal and transversal clearances. Channels 4 are usually formed of a plurality of grooves which are created by hammering in a broaching process. The width and number of the grooves may be optimally sized as appropriate.

Figure 2:
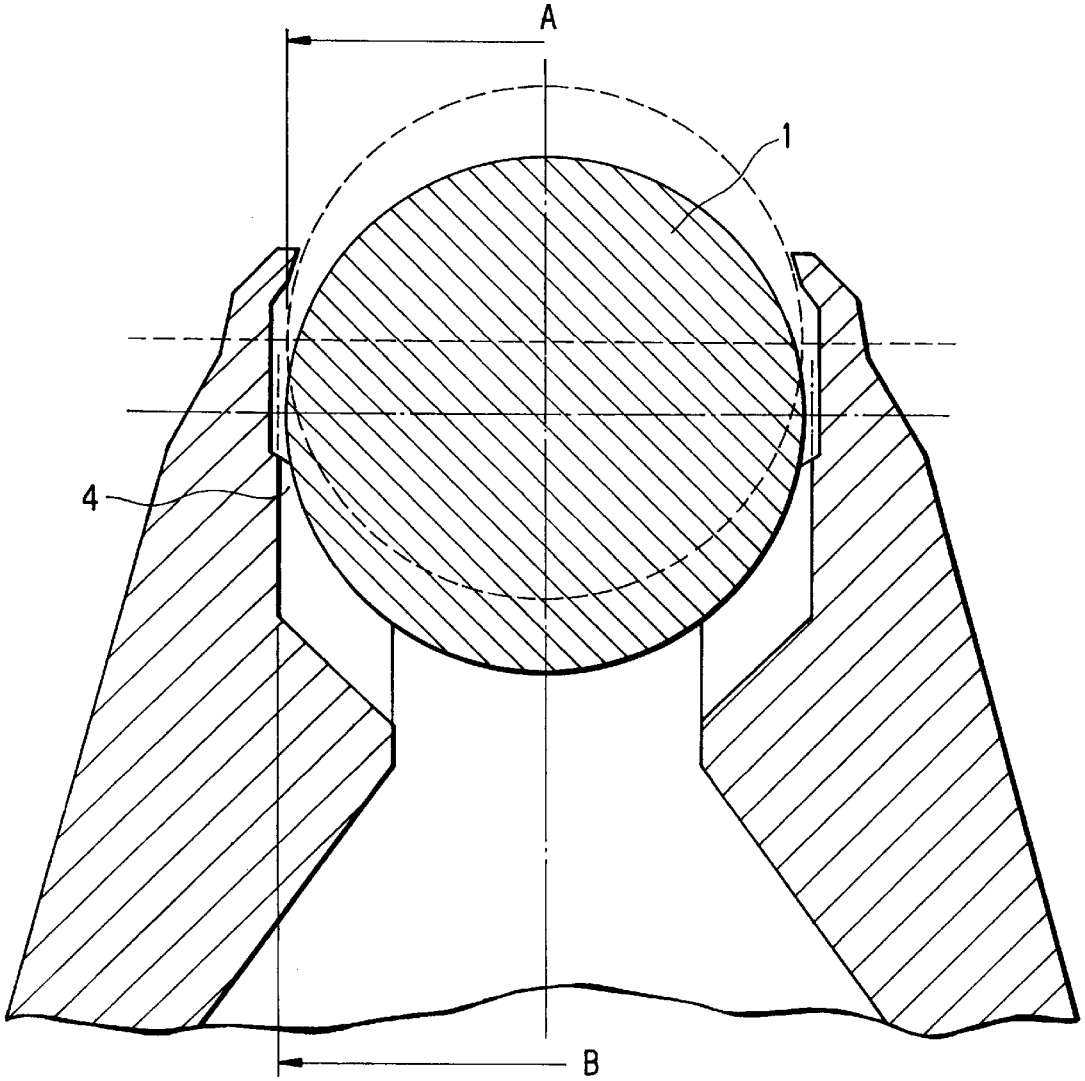
FIG. 2 is a vertical sectional view showing an worn-out state of a point assembly of the ball-point pen of the embodiment of the invention.
Figure 3:
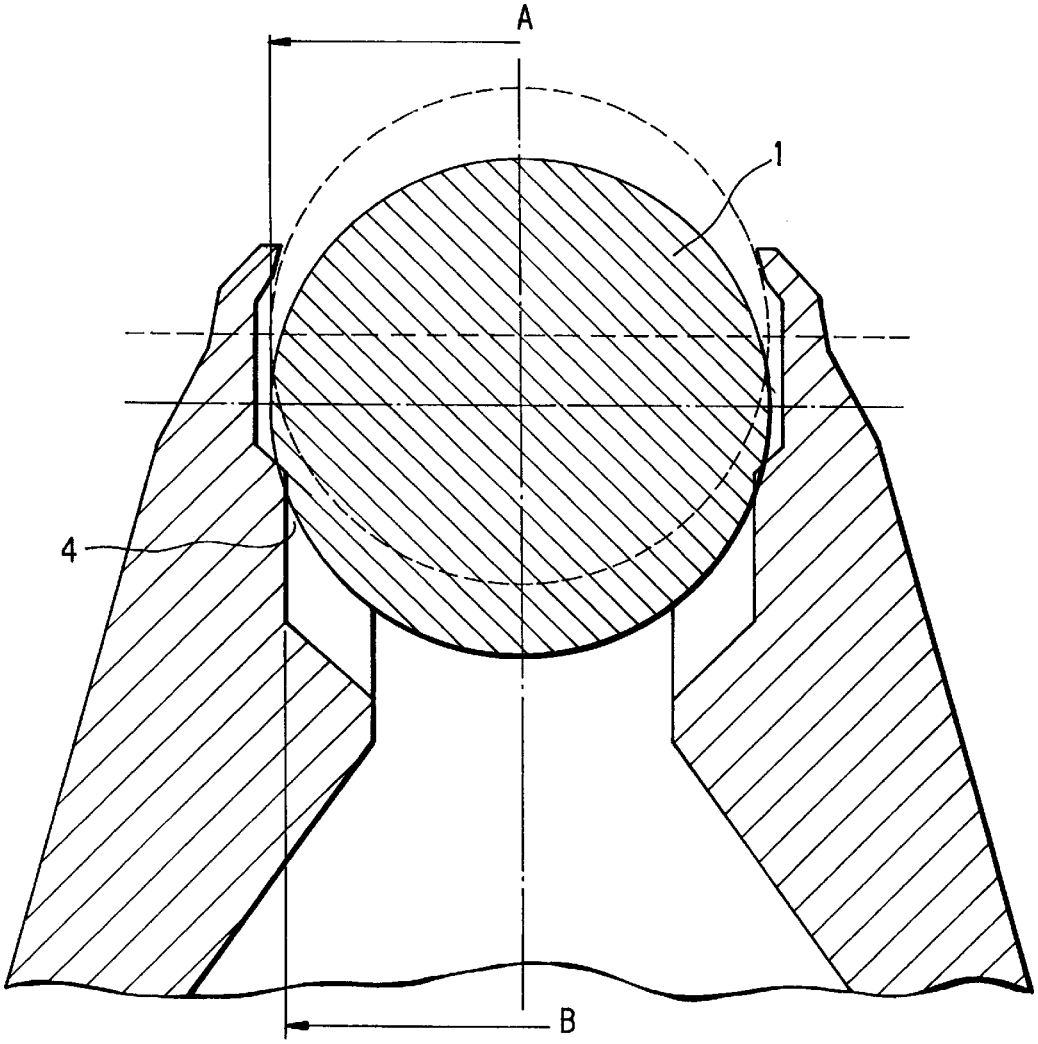
FIG. 3 PRIOR ART
FIG. 3 is a vertical sectional view showing an worn-out state of a point assembly of a conventional ball-point pen.

In the present invention, the extradius (designated at B) of channels 4 is set equal to or greater than the radius A of ball 1. This setting preventing channels 4 from being confined if ball 1 has become recessed, as shown in FIG. 2, into the seat because of being worn-out due to writing, establishing the passage of ink, so as to at least ensure 'writing' even when the projected amount of the ball has become extremely small. FIG. 3 shows an worn-out state of the conventional configuration. The worn-out amount here is equal to that shown in FIG. 2. As seen, channels 4 are completely confined by ball 1, eliminating the passage of ink and hence resulting in writing deficiency.

Not sticking at only the comparison between the final worn-out states shown in the figures, the one having a point assembly of the invention secures a satisfactory passage of ink from the initial stage of writing, ensuring smooth writing with a large enough amount of ink from the beginning. Thus, the performance of the product of the present invention can be easily and stably maintained.

It is more effective if a spring which can slightly urge the ball forward is provided inside the point assembly by forming a press-formed hold at the rear end of the point assembly. This spring may have a straight portion in the front part thereof to directly urge the ball, or may have other configurations such that a spring is used with a separate piece whose rear end is urged by the spring, or the rear end of the spring may be fixed so as not to come out, by a stepped portion in the bore of the joint instead of being press formed at points. Further, the spring may be formed of resin, rubber or be a leaf spring etc. Any of these may be effective and show no difference.

The ink used in the embodiment has a viscosity of 10 cp to 5,000 cp at the temperature of 23° C.±5° C. under normal shearing force, and comprises: water as the base, other solvents such as glycerin, propylene glycol etc., in an amount of 5 to 50%, pigments and/or dyes as coloring matter in an amount of 1 to 20%, and other various additives, such as dispersant, gelatinizer, preservative, surfactant, lubricant etc. as appropriate. Now, considering the reduction from evaporation as it relates to total performance of ball-point pens, the use of the point assembly of the invention improves the sealing performance at the tip portion of the pen, so as to suppress the evaporation of water from the pen. This feature enables the provision of a cap-less ball-point pen even when using an ink which is usually known to dry easily, and also makes it possible to solve the problems of an intermediate type ball-point pen using aqueous ink of a retractable or clicking type—which were unfeasible in the prior art, as well as the problems of a ball-point pen having a cap with no sealing member therein, and the problems of an oily ball-point pen and of a direct liquid type ball-point pen. Of course, if the configuration of the present invention is used in combiation with the conventional cap type or pressing type barrel mechanism, it is possible to provide a further improved, special ball-point pen.

The implementation of the invention is effective in solving the problems of the writing deficiency due to wearing out, of scratchy sensation of writing at the initial stage of use and of insufficiency in ink flow.

In accordance with the invention, since it is possible to create reliable sealing at the pen tip, the pen does not need a cap (a cap-less configuration) or only needs a simple type of cap, without the necessity of high sealing ability therein. Therefore, it becomes possible to stably provide low-cost writing implements which are ready to be assembled as well as writing implements of a retractable type which were unfeasible in the prior art. Further, it is possible to solve the problems such as forward leakage, air drawing, ink starvation and the problems of durability to wearing out such as ball-falling even in a ball-point pen using an aqueous type ink which easily gets dry, without using any special ink or any complicated barrel mechanisms. In particular, it is possible to expect further improved effects, especially when a configuration is used in which a spring is incorporated inside the point assembly so as to continuously press the writing ball forward in close contact with the interior sealing face of the invention or when the dimensions of each element and the reduction from evaporation is limited to the range of the invention. The present invention is effective in solving most of the defects in a so-called intermediate type ball-point pen using a medium viscosity ink, which had many drawbacks. When the present invention is used in combination with ink which has thixotropy, i.e., an ink where viscosity varies by the action of shearing force, a further improved effect can be obtained because the ink has a relatively high viscosity during storage and presents a reduced viscosity during writing when shearing force is applied by the ball. Additionally, the present invention can show the same effects if it is applied to conventional oily type ball-point pens or, sliver type ball-point pens, direct liquid type aqueous ball-point pens using an ink storage part of many comb-like slits and other types of ball-point pens. The present invention is more effective in providing a writing implement free from the problem of backward leakage when it is combined with an anti-backward leakage mechanism such as a checking valve ball etc.

What is claimed is:

1. A point assembly of a ball-point pen, the point assembly having a front end and a rear end, the point assembly comprising:

a ball, received on the rear side thereof by a ball seat and held on the front side thereof by a press-formed portion so that part of the ball is projected from the front end, and loosely held so that the back-and-forth movement of the ball is limited therebetween;

an ink conduit extending from the rear end to the ball seat for allowing ink to be led to the ball; and a plurality of grooves which form channels so that the ball seat and the ink conduit communicate with one another in order to lead the writing ink to the front exterior of the pen point even when the ball abuts the ball seat and confines the ink conduit during writing, the plurality of grooves not penetrating at the rear end;

wherein the maximum extradius (B) of the channels defined by the plural grooves is equal to the radius (A) of the ball of a sphere having a diameter of 2A, (B=A), the maximum extradius (B) being equal to the radius (A) prior to and after insertion of the ball into the ball seat;

wherein the ball seat having the ball abutted thereagainst and receiving writing pressure during writing, has a ball-receiving face having a radius of curvature R which is approximately equal to that of the ball, and a surface roughness Ra of the area of radius of curvature R is 5$\mu$m or below;

wherein the point assembly is adapted for use with an ink having a viscosity of 10 cp to 5,000 cp at a temperature of 23° C.±5° C. under normal shearing forces, and5 comprises: water as the base, at least one other solvent selected from the group consisting of glycerin and propylene glycol, in an amount of 5 to 50%, and pigments and/or dyes as coloring matter in an amount of 1 to 20%; and wherein the front end of the point assembly is further provided with a press-formed portion formed with a press forming angle of 70° to 90° for preventing the ball from slipping out with its curved interior face forming a sealing face having a surface roughness of 5 $\mu$m or less.

* * * * *